US008953957B2

(12) United States Patent
Takehisa et al.

(10) Patent No.: US 8,953,957 B2
(45) Date of Patent: Feb. 10, 2015

(54) IMAGE FORMING APPARATUS INCLUDING A SURFACE POTENTIAL DETECTOR

(71) Applicants: Akira Takehisa, Tokyo (JP); Yasushi Nakazato, Tokyo (JP); Mikiko Imazeki, Kanagawa (JP); Osamu Satoh, Kanagawa (JP)

(72) Inventors: Akira Takehisa, Tokyo (JP); Yasushi Nakazato, Tokyo (JP); Mikiko Imazeki, Kanagawa (JP); Osamu Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/903,405

(22) Filed: May 28, 2013

(65) Prior Publication Data

US 2014/0016951 A1 Jan. 16, 2014

(30) Foreign Application Priority Data

Jul. 13, 2012 (JP) ..... 2012-157774
Feb. 28, 2013 (JP) ..... 2013-038719

(51) Int. Cl.
*G03G 15/00* (2006.01)
*G03G 21/00* (2006.01)

(52) U.S. Cl.
CPC ..... *G03G 15/55* (2013.01); *G03G 15/5037* (2013.01); *G03G 21/0094* (2013.01)
USPC ..... 399/26

(58) Field of Classification Search
USPC ..... 399/26
See application file for complete search history.

(56) References Cited

U.S. PATENT DOCUMENTS

| | | | |
|---|---|---|---|
| 2010/0098471 | A1 | 4/2010 | Satoh et al. |
| 2011/0091226 | A1 | 4/2011 | Ishigaya et al. |
| 2011/0170884 | A1 | 7/2011 | Yamane et al. |
| 2012/0065885 | A1 | 3/2012 | Imazeki et al. |
| 2012/0075659 | A1 | 3/2012 | Sawada et al. |

FOREIGN PATENT DOCUMENTS

| | | |
|---|---|---|
| JP | 2005-017512 | 1/2005 |
| JP | 2008-209801 | 9/2008 |

*Primary Examiner* — David Bolduc
*Assistant Examiner* — Barnabas Fekete
(74) *Attorney, Agent, or Firm* — Oblon, Spivak, McClelland, Maier & Neustadt, L.L.P.

(57) ABSTRACT

An image forming apparatus includes an image forming unit including a latent image carrier, a charging device, a latent image writing device, and a development device; a cumulative value calculation device that calculates, for each of regions of a surface of the image carrier, a cumulative value of the area of a latent image formed in the region; a surface potential detector that detects the surface potential of the image carrier in one of the regions as a detection region; and a determination device that determines the deterioration degree of the detection region on the basis of the detected potential, and determines the deterioration degree of a region other than the detection region on the basis of the detected potential, the cumulative value for the detection region, and the cumulative value for the region other than the detection region.

8 Claims, 8 Drawing Sheets

IMAGE FORMING APPARATUS INCLUDING A SURFACE POTENTIAL DETECTOR

CROSS-REFERENCE TO RELATED APPLICATIONS

This patent application is based on and claims priority pursuant to 35 U.S.C. §119 to Japanese Patent Application No. 2012-157774, filed on Jul. 13, 2012, in the Japan Patent Office, and Japanese Patent Application No. 2013-038719, filed on Feb. 28, 2013, in the Japan Patent Office, the entire disclosures of which are hereby incorporated by reference herein.

BACKGROUND

1. Technical Field

The present invention relates to an image forming apparatus including a determination device which determines the degree of deterioration of a latent image carrier on the basis of the result of detection of the surface potential of the latent image carrier.

2. Related Art

In an image forming apparatus which forms an image through an electrophotographic process, a surface of a latent image carrier is uniformly charged by a charging device such as a corona charger, and a latent image having an electric potential different from the uniformly charged potential is written on the latent image carrier by, for example, optical scanning. Then, the latent image is developed by a development device with toner selectively adhering to the latent image on the latent image carrier. The thus-obtained toner image is transferred to a recording sheet (i.e., recording medium) directly or via an intermediate transfer member. Thereby, a recording sheet having the toner image formed thereon is obtained. After the transfer of the toner image, residual charge on the latent image carrier is removed by a discharging device, and the latent image carrier is again uniformly charged by the charging device to prepare for the next latent image formation.

In the configuration which performs such an electrophotographic process, the charging performance of the latent image carrier is gradually degraded by repeated uniform charging, latent image writing, and discharging performed on the latent image carrier. It is difficult to form a latent image with a stable potential on the latent image carrier substantially degraded in charging performance, and thus to maintain normal image quality.

Therefore, the image forming apparatus may be configured to, immediately after the surface of the rotatable drum-shaped latent image carrier is uniformly charged by the charging device, detect the uniformly charged potential by using a potential sensor, and, if the result of detection falls below a predetermined threshold value, determine that the latent image carrier has deteriorated significantly and prompt a user to replace the latent image carrier. Thereby, the user is prompted to replace the latent image carrier before the latent image carrier deteriorates too much to form a latent image with a stable potential. Accordingly, image deterioration due to the deterioration of the latent image carrier is minimized

SUMMARY

The present invention describes a novel image forming apparatus that, in one example, includes an image forming unit, a cumulative value calculation device, a surface potential detector, and a determination device. The image forming unit includes a latent image carrier configured to carry a latent image on a moving surface thereof, a charging device configured to charge the surface of the latent image carrier, a latent image writing device configured to write the latent image on the charged surface of the latent image carrier, and a development device configured to develop the latent image carried on the surface of the latent image carrier. The cumulative value calculation device is configured to calculate, for each of a plurality of regions into which the surface of the latent image carrier is divided in a direction perpendicular to a direction of rotation of the latent image carrier, a cumulative value of the area of the latent image formed in the region. The surface potential detector is configured to detect the electric potential of the surface of the latent image in one of the plurality of regions as a detection region. The determination device is configured to determine the degree of deterioration of the latent image carrier on the basis of the readings from the surface potential detector. The determination device determines the degree of deterioration of the detection region on the basis of the readings, and determines the degree of deterioration of a region other than the detection region on the basis of the readings, the cumulative value for the detection region, and the cumulative value for the region other than the detection region.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
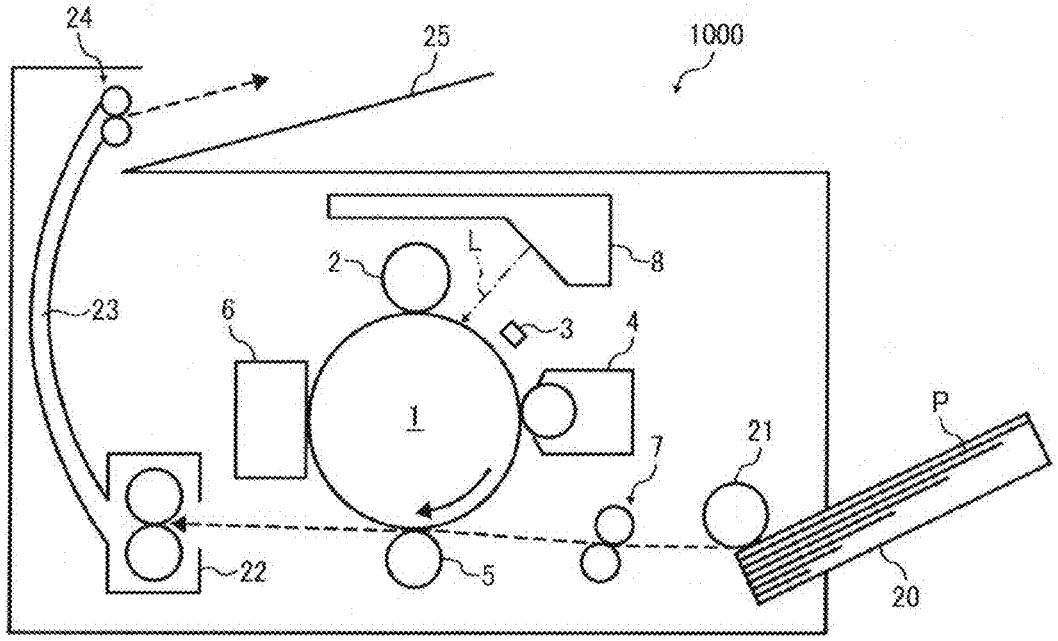
FIG. 1 is a schematic configuration diagram illustrating a printer according to an embodiment of the present invention.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, a printer as an image forming apparatus according to an embodiment of the present invention configured to form an image in accordance with an electrophotographic method will be described. The printer according to the embodiment described below is merely an example of an image forming apparatus according to an embodiment of the present invention, and embodiments of the present invention are not limited to the printer according to the embodiment.

FIG. 1 is a schematic configuration diagram illustrating a printer 1000 according to the embodiment. The printer 1000 according to the embodiment includes a drum-shaped photoconductor 1, a charging device 2, a surface potential sensor 3, a development device 4, a transfer device 5, a discharge cleaning device 6, a registration roller pair 7, an optical writing device 8, a sheet feeding cassette 20 storing a recording sheet (i.e., recording medium) P, a sheet feed roller 21, a fixing device 22, a sheet discharge path 23, a sheet discharge roller pair 24, and a sheet discharge tray 25. Herein, at least the photoconductor 1, the charging device 2, the development device 4, and the optical writing device 8 form an image forming unit.

The drum-shaped photoconductor 1 serving as a latent image carrier includes a drum base body having an outer circumferential surface including an organic photosensitive layer, and is driven to rotate clockwise in FIG. 1 by a not-illustrated drive device. The photoconductor 1 is surrounded by the charging device 2, the surface potential sensor 3, the development device 4, the transfer device 5, and the discharge cleaning device 6.

At a position facing the photoconductor 1, the charging device 2 uniformly charges the outer circumferential surface of the photoconductor 1 being driven to rotate. The present printer 1000 employs, as the charging device 2, a system that supplies a charging bias to a charging brush roller being driven to rotate while in contact with the photoconductor 1, to thereby uniformly charge the photoconductor 1. This system may be replaced by a scorotron charger disposed to face the outer circumferential surface of the photoconductor 1 with a predetermined gap formed therebetween. Alternatively, the charging device 2 may include a charging roller that is supplied with a charging bias while in contact with or in proximity to the outer circumferential surface of the photoconductor 1, to thereby cause discharge between the charging roller and the photoconductor 1 and uniformly charge the outer circumferential surface of the photoconductor 1.

The outer circumferential surface of the photoconductor 1 uniformly charged by the charging device 2 is optically scanned with writing light L emitted from the optical writing device 8 serving as a latent image writing device. A region of the outer circumferential surface of the photoconductor 1 irradiated with the writing light L by optical scanning is attenuated in potential to carry an electrostatic latent image.

Figure 2:
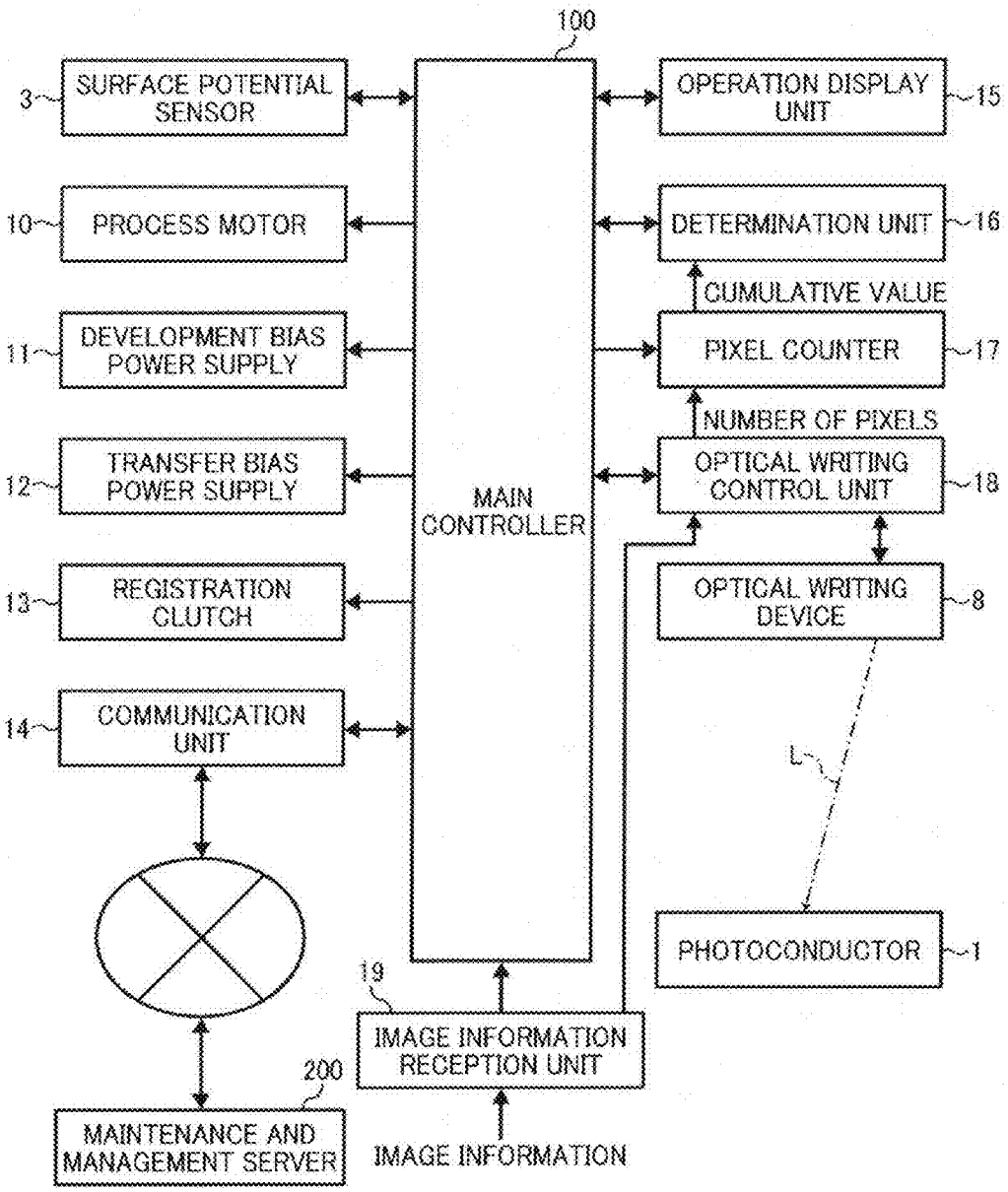
FIG. 2 is a block diagram illustrating a part of an electric circuit of the printer and a maintenance and management server separated from the printer.

The surface potential sensor 3 serving as a surface potential detector detects a background portion potential Vd (i.e., the potential of a background portion of the uniformly charged photoconductor 1) and a latent image potential V1 (i.e., the potential of the electrostatic latent image) in accordance with an existing technique, and outputs the results of detection to a main controller 100 illustrated in FIG. 2.

As the photoconductor 1 is driven to rotate, the outer circumferential surface of the photoconductor 1 passes a position facing the surface potential sensor 3, and reaches a position facing the development device 4. The developer 4 contains a one-component developer or a two-component developer. In an area in which the development device 4 faces the photoconductor 1, the development device 4 causes toner to adhere to the electrostatic latent image on the photoconductor 1, to thereby develop the electrostatic latent image and obtain a toner image. As the photoconductor 1 is further driven to rotate, the thus-developed toner image reaches a transfer area in which the photoconductor 1 faces the transfer device 5.

The sheet feeding cassette 20 storing a stack of recording sheets P is installed in the body of the printer 1000. The uppermost recording sheet P of the stack stored in the sheet feeding cassette 20 is in contact with the sheet feed roller 21. The sheet feed roller 21 is driven to rotate with predetermined timing to feed the recording sheet P from the sheet feeding cassette 20 to a sheet feed path.

Near an end of the sheet feed path, the registration roller pair 7 is disposed which includes paired registration rollers that are rotated while in contact with each other. When the registration roller pair 7 nips the recording sheet P in a registration nip formed by the registration rollers, the rotation of the registration rollers is temporarily stopped. Then, the registration rollers are again driven to rotate with appropriate timing for superimposing the toner image on the photoconductor 1 onto the recording sheet P in the transfer area, and feed the recording sheet P to the transfer area in which the photoconductor 1 faces the transfer device 5.

The transfer device 5 generates, between the recording sheet P fed to the transfer area and the electrostatic latent image on the photoconductor 1, a transfer electric field for electrostatically moving the toner from the photoconductor 1 to the recording sheet P. Due to the action of the transfer electric field, the toner image on the photoconductor 1 is transferred onto a surface of the recording sheet P fed to the transfer area. The present printer 1000 employs, as the transfer device 5, a system that supplies a transfer bias to a transfer roller which comes into contact with the photoconductor 1 to form a transfer nip, to thereby transfer the toner image on the photoconductor 1 onto the recording sheet P nipped in the transfer nip. This type of transfer device 5 may be replaced by an existing corona charger. Alternatively, the transfer device 5 may be a system that supplies a transfer bias to a transfer member different from the transfer roller, while the transfer member is in contact with the photoconductor 1.

The recording sheet P passes the transfer area, and is fed to the fixing device 22. In the fixing device 22, a fixing nip is formed by a fixing roller including therein a heat generation source such as a halogen heater and a pressure roller pressed against the fixing roller. The recording sheet P fed to the fixing device 22 is subjected to heat and pressure in the fixing nip to fix the toner image on the surface of the recording sheet P.

Meanwhile, the outer circumferential surface of the photoconductor 1 passes the transfer area, and reaches a position facing the discharge cleaning device 6. The discharge cleaning device 6 includes a discharge lamp and a cleaning member, which are not illustrated. The cleaning member scrapes off post-transfer residual toner adhering to the outer circumferential surface of the photoconductor 1. Thereafter, the discharge lamp radiates discharge light onto the outer circumferential surface of the photoconductor 1 to discharge the outer circumferential surface of the photoconductor 1. The discharged outer circumferential surface of the photoconductor 1 is again uniformly charged by the charging device 2 to prepare for the next latent image formation.

The recording sheet P passes through the fixing device 22, and is discharged outside the body of the printer 1000 via the sheet discharge path 23 and a sheet discharge nip formed by the sheet discharge roller pair 24. The recording sheet P is then stacked on the sheet discharge tray 25 provided outside the body of the printer 1000.

FIG. 2 is a block diagram illustrating a part of an electric circuit of the printer 1000 according to the embodiment and a maintenance and management server 200 separated from the printer 1000 according to the embodiment. In the present embodiment, the maintenance and management server 200 illustrated in FIG. 2 is a personal computer installed in a facility of a maintenance and management service provider remote from a location at which the printer 1000 according to the embodiment is installed. The maintenance and management server 200 is capable of communicating with the printer 1000. In FIG. 2, devices other than the maintenance and management server 200 are included in the printer 1000 according to the embodiment.

The main controller 100 controls the driving of devices included in the printer 1000, and includes a central processing unit (CPU), a random access memory (RAM) serving as a data storage device, and a read-only memory (ROM) serving as a data storage memory. On the basis of programs stored in the ROM, the main controller 100 controls the driving of the devices and executes predetermined arithmetic processing.

The main controller 100 is connected to the surface potential sensor 3, a process motor 10, a development bias power supply 11, a transfer bias power supply 12, a registration clutch 13, a communication unit 14, an operation display unit 15, a determination unit 16, a pixel counter 17, an optical writing control unit 18, and an image information reception unit 19.

The image information reception unit 19 receives image information transmitted from a not-illustrated personal computer or scanner and transmits the image information to the main controller 100 and the optical writing control unit 18. The optical writing control unit 18 controls the driving of the optical writing device 8 on the basis of the image information transmitted from the image information reception unit 19, to thereby optically scan the outer circumferential surface of the photoconductor 1. The optical writing device 8 that optically scans the photoconductor 1 with the writing light L may be, for example, an existing laser writing optical system or light emitting diode (LED) array.

The process motor 10 serves as a drive source of the photoconductor 1, the development device 4, and various rollers. Rotational drive force of the process motor 10 is transmitted to the registration roller pair 7 (see FIG. 1) via the registration clutch 13. When the main controller 100 engages the registration clutch 13 with predetermined timing, the rotational drive force of the process motor 10 is transmitted to the registration roller pair 7.

The above-described development device 4 includes a development roller, and causes the toner carried on an outer circumferential surface of the development roller to adhere to the electrostatic latent image on the photoconductor 1. To cause the toner to selectively adhere to the electrostatic latent image on the outer circumferential surface of the photoconductor 1, the development roller is supplied with a development bias which is the same in polarity as the toner, and the absolute value of which is larger than the absolute value of the latent image potential V1 and smaller than the absolute value of the background portion potential Vd of the photoconductor 1. For example, under a condition of a background portion potential Vd of approximately −800 V and a latent image potential V1 of approximately −50 V, a development bias of approximately −400 V is supplied to the development roller. The development bias power supply 11 outputs the above-described development bias. The main controller 100 transmits an output command signal to the development bias power supply 11 to cause the development bias power supply 11 to output the development bias with predetermined timing.

Further, the main controller 100 transmits an output command signal to the transfer bias power supply 12 with predetermined timing to cause the transfer bias power supply 12 to output a transfer bias. The transfer bias is a voltage for generating a transfer electric field between the recording sheet P and the electrostatic latent image on the photoconductor 1 in the transfer area in which the photoconductor 1 faces the transfer device 5.

The communication unit 14 performs a process for data communication between the main controller 100 and the maintenance and management server 200. Further, the operation display unit 15 includes a touch panel and numeric keys, which are not illustrated. The operation display unit 15 displays an image on the touch panel, and transmits information input through the touch panel or the numeric keys to the main controller 100.

The readings of the surface potential of the photoconductor 1 detected by the surface potential sensor 3 are transmitted to the main controller 100 in the form of a digital signal, and then is transmitted to the determination unit 16. The determination unit 16 serves as a determination device that determines the degree of deterioration of the photoconductor 1 on the basis of the detected surface potential. Then, if it is determined that the photoconductor 1 has deteriorated significantly, the determination unit 16 transmits a life end signal to the main controller 100. Upon receipt of the life end signal from the determination unit 16, the main controller 100 causes the operation display unit 15 to display a message reading, for example, "The photoconductor is failing. Please replace." The functions of the pixel counter 17 will be described in detail later.

Figure 3:
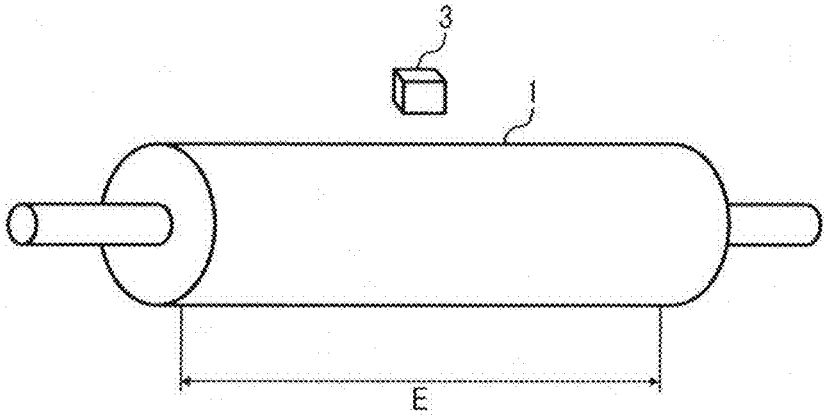
FIG. 3 is a perspective view illustrating a photoconductor and a surface potential sensor of the printer.

FIG. 3 is a perspective view illustrating the photoconductor 1 and the surface potential sensor 3. As illustrated in FIG. 3, the surface potential sensor 3 is disposed to detect the surface potential of a central region of the photoconductor 1 in the rotation axis direction of the photoconductor 1 (i.e., main scanning direction). It is possible to determine the degree of deterioration of the central region on the basis of the readings of the surface potential of the central region. However, it is difficult to determine the degree of deterioration of a region of the photoconductor 1 different from the central region simply on the basis of the readings of the surface potential of the central region.

In general, in an image forming apparatus which detects the uniformly charged potential of the outer circumferential surface of a photoconductor (i.e., latent image carrier) by using a potential sensor, if the degree of deterioration of the photoconductor substantially varies in the rotation axis direction of the photoconductor, it is difficult to detect the end of life of the photoconductor with appropriate timing, and thus image deterioration may be caused. Specifically, the higher the frequency of latent image writing on the photoconductor is, the faster the photoconductor deteriorates. Further, if the frequency of latent image writing varies in the rotation axis direction of the photoconductor in an extended process, such as a process of making hundreds of thousands of prints, for example, the degree of deterioration of the photoconductor varies in accordance with the variation in frequency of latent image writing. That is, the deterioration progresses faster in a region in the rotation axis direction of the photoconductor with a relatively high frequency of latent image writing, and progresses more slowly in a region in the rotation axis direction of the photoconductor with a relatively low frequency of latent image writing.

If the image forming apparatus is configured to detect the uniformly charged potential of a central region in the rotation axis direction of the photoconductor by using the potential sensor, it is possible to detect the degree of deterioration of the central region in the rotation axis direction of the photoconductor, but it is difficult to detect the degree of deterioration of opposed end regions in the rotation axis direction of the photoconductor. If the opposed end regions deteriorate faster than the central region, therefore, the image forming apparatus fails to detect the end of life of the opposed end regions and prompt a user to replace the photoconductor. As a result, image deterioration is caused.

If a plurality of potential sensors are provided along the rotation axis direction, it is possible to detect the degree of deterioration not only in the central region but also in the opposed end regions in the rotation axis direction of the photoconductor. Such a configuration with a plurality of potential sensors, however, increases costs.

By contrast, according to the printer 1000 (i.e., image forming apparatus) of the present embodiment, it is possible to detect the degree of deterioration in each of a plurality of regions of the outer circumferential surface of the photoconductor 1 (i.e., latent image carrier) aligned in a direction perpendicular to a direction of rotation of the outer circumferential surface of the photoconductor 1, with no need to provide a plurality of surface potential sensors 3 (i.e., surface potential detectors). This feat is accomplished as follows.

The printer 1000 according to the embodiment is capable of forming an image on a recording sheet P of up to the A3-size (hereinafter also referred to as the A3-size sheet). Therefore, the length in the rotation axis direction of the photoconductor 1 is slightly longer than 297 mm, which corresponds to the short side length of the A3-size sheet, i.e., the long side length of a recording sheet P of the A4 size (hereinafter also referred to as the A4-size sheet). To form an image on the A3-size sheet, the A3-size sheet is passed through the transfer area, with the short sides of the A3-size sheet aligned with the rotation axis direction of the photoconductor 1. Meanwhile, to form an image on the A4-size sheet, the A4-size sheet is passed through the transfer area, with the long sides of the A4-size sheet aligned with the rotation axis direction of the photoconductor 1.

Figure 4:
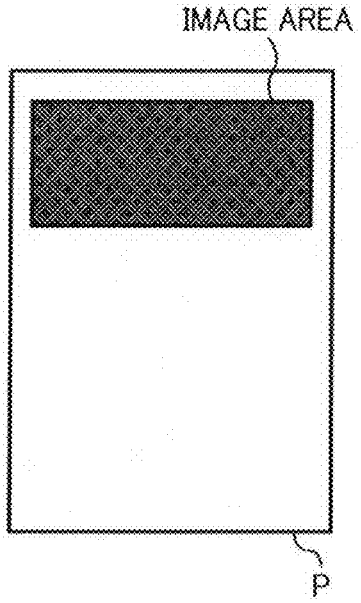
FIG. 4 is a schematic diagram illustrating an A4-size recording sheet and an image formed thereon.

FIG. 4 is a schematic diagram illustrating the recording sheet P of the A4 size and an image formed thereon. A solid image is formed in a page top end region (i.e., a front end region in the longitudinal direction) of the A4-size sheet illustrated in FIG. 4.

Figure 5:
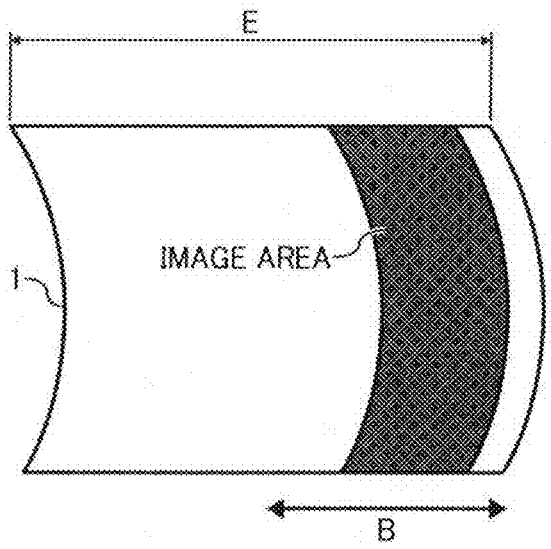
FIG. 5 is a schematic diagram schematically illustrating a circumferential surface of the photoconductor, rendered as a plane.

FIG. 5 is a schematic diagram schematically illustrating the outer circumferential surface of the photoconductor 1, rendered as a plane. In FIG. 5, the direction of arrow B indicates the rotation axis direction of the photoconductor 1. When the solid image illustrated in FIG. 4 is formed on the A4-size sheet, the solid image is formed in one end region in the rotation axis direction of the photoconductor 1, as illustrated in FIG. 5. Therefore, the optical writing process is limited to the one end region.

If the solid image as illustrated in FIG. 4 is frequently output, the frequency of optical writing is higher in the one end region than in the other regions in the rotation axis direction of the photoconductor 1. As a result, the one end region deteriorates faster than the other regions. As illustrated in FIG. 3, however, the surface potential sensor 3 is disposed to detect the potential of the central region in the rotation axis direction of the photoconductor 1, and the frequency of optical writing is lower in the central region than in the one end region. Even if the one end region deteriorates significantly, the life of the central region has not expired. It is therefore difficult for the determination unit 16 to detect the end of life of the one end region simply on the basis of the readings of the surface potential of the central region. As a result, the photoconductor 1 may continue to be used without display of the message prompting the replacement of the photoconductor 1 even after the end of life of the one end region, and image deterioration may be caused.

A detailed configuration of the printer 1000 according to the embodiment will now be described. In FIG. 3, E represents the optical writing effective length in the rotation axis direction of the photoconductor 1. Optical writing effective length refers to the length in the rotation axis direction of a region of the photoconductor 1 subjected to optical scanning (hereinafter referred to as the optical scanning region). Each of the opposed ends in the rotation axis direction of the optical scanning region is separated from the corresponding end in the rotation axis direction of a drum portion of the photoconductor 1 (i.e., a portion of the photoconductor 1 not including a shaft thereof) by a predetermined distance. The optical writing effective length E is therefore shorter than the entire length of drum portion of the photoconductor 1.

Figure 6:
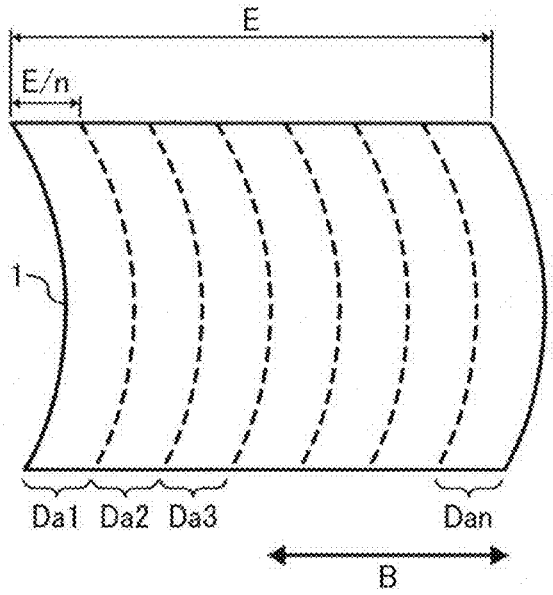
FIG. 6 is a schematic diagram illustrating regions of the photoconductor.

FIG. 6 is a schematic diagram illustrating regions of the photoconductor 1. In the printer 1000 according to the embodiment, the degree of deterioration is detected for each of the n number of regions obtained by equally dividing the optical scanning region in the rotation axis direction of the photoconductor 1 by the number n. The photoconductor 1 is disposed in a housing of the printer 1000 such that the rotation axis direction of the photoconductor 1 is aligned with the anteroposterior direction of the body of the printer 1000. The first region Da1 of the n number of regions of the photoconductor 1 is located at the head (i.e., foremost position) in the rotation axis direction of the photoconductor 1 corresponding to the direction of arrow B, and the n-th region Dan is located at the tail (i.e., rearmost position) in the rotation axis direction of the photoconductor 1.

On the basis of the image information, the optical writing control unit 18 illustrated in FIG. 2 counts the number of optically written pixels per rotation of the photoconductor 1, at every rotation of the photoconductor 1 and for each of the first to n-th regions Da1 to Dan of the photoconductor 1. The optical writing control unit 18 then outputs the respective count results to the pixel counter 17. The number of optically written pixels reflects the area of the optically written latent image. That is, the pixel counter 17 serving as a cumulative value calculation device calculates, as the cumulative value of the area of the latent image formed in each of the regions divided in the direction perpendicular to the direction of rotation of the outer circumferential surface of the photoconductor 1, the cumulative value of the number of pixels of the formed latent image. According to this configuration, the frequency of latent image writing in each of the regions is obtained by simple calculation using the number of pixels, which is easily counted by the optical writing control unit 18 serving as a latent image writing control device, as an alternative to the area of the image.

The pixel counter 17 accumulates, for each of the first to n-th regions Da1 to Dan, the number of optically written pixels transmitted from the optical writing control unit 18, to thereby calculate the cumulative value of the number of pixels. The pixel counter 17 then outputs the respective calculation results of the cumulative values to the determination unit 16.

The present printer 1000 performs a common process control at regular intervals, such as at intervals of a predetermined number of prints. The process control is performed to output images at a substantially constant density over an extended period of time irrespective of an environmental change or the like. Therefore, image forming conditions such as the background portion potential Vd of the photoconductor 1, the optical writing intensity, and the development bias are corrected as necessary. In some cases, the power to be supplied to the charging device 2 may be adjusted to reduce the background portion potential Vd from approximately −800 V to approximately −750 V, for example. It is therefore difficult to detect the degree of deterioration of the photoconductor 1 simply on the basis of the readings of the background portion potential Vd of the photoconductor 1 detected by the surface potential sensor 3.

Therefore, the present printer 1000 is configured to determine the degree of deterioration of the photoconductor 1 on the basis of not only the background portion potential Vd of the photoconductor 1 but also the latent image potential V1 of the photoconductor 1 and a residual potential Vr (i.e., the potential of the discharged background portion), for example. The determination is made in a determination process performed at regular intervals.

In the determination process, the photoconductor 1 being driven to rotate is first uniformly charged by the charging device 2, with the output of the development bias and the transfer bias stopped. Then, the background portion potential Vd is measured by the surface potential sensor 3, and is stored as a measured background portion potential value V1. Further, a solid electrostatic latent image is written on the background portion of the photoconductor 1 by the optical writing device 8, and the potential of the solid electrostatic latent image is measured by the surface potential sensor 3 and stored as a measured latent image potential value V2. Thereafter, the background portion of the photoconductor 1 is moved to a position facing the discharge cleaning device 6, and is discharged by the discharge lamp of the discharge cleaning device 6. The background portion of the photoconductor 1 is then further moved to a position facing the surface potential sensor 3, without being uniformly charged by the charging device 2. Then, the potential of the background portion is measured by the surface potential sensor 3 and stored as a measured residual potential value V3.

With the deterioration of the photoconductor 1, the attenuation rate of the potential of the photoconductor 1 due to optical writing declines, and thus the measured latent image potential value V2 increases. Accordingly, the value V2/V1 resulting from dividing the measured latent image potential value V2 by the measured background portion potential value V1 also increases. Further, with the deterioration of the photoconductor 1, the discharge rate of the background portion of the photoconductor 1 declines, and thus the measured residual potential value V3 increases. Accordingly, the value V3/V1 resulting from dividing the measured residual potential value V3 by the measured background portion potential value V1 also increases.

On the basis of the value V2/V1 and the value V3/V1, therefore, it is possible to determine the degree of deterioration of the photoconductor 1. The thus-determined degree of deterioration, however, reflects the degree of deterioration of a given region in the rotation axis direction of the photoconductor 1, in which the surface potential is detected by the surface potential sensor 3.

As described above, the present printer 1000 detects the degree of deterioration of each of the n number of regions obtained by equally dividing the optical scanning region in the rotation axis direction of the photoconductor 1 by the number n. Actual detection of the surface potential by the surface potential sensor 3 is limited to one of the n number of regions. Hereinafter, one of the n number of regions subjected to the detection of the surface potential by the surface potential sensor 3 will be referred to as the detection region, and each of the other regions not subjected to the detection of the surface potential by the surface potential sensor 3 will be referred to as the non-detection region. In the present embodiment, the detection region is the central region in the rotation axis direction of the photoconductor 1. That is, the numerical value V2/V1 or the value V3/V1 reflects the degree of deterioration of the central region.

Relative differences in degree of deterioration between the plurality of regions are detectable on the basis of the cumulative value of the number of pixels calculated for each of the regions. Specifically, the degree of deterioration of the region increases with an increase in cumulative value of the number of pixels. Therefore, the region having the largest cumulative value of the number of pixels has deteriorated most. Thus, whether or not the life of the photoconductor 1 has expired may be determined on the basis of the degree of deterioration of the most heavily deteriorated region. Hereinafter, the cumulative value of the number of pixels in the central region will be referred to as the central cumulative value CTc.

It is assumed that the cumulative value of the number of pixels is largest in the central region of the plurality of regions, i.e., that the central region has deteriorated most. In this case, if the value V2/V1 exceeds a predetermined first threshold, or if the value V3/V1 exceeds a predetermined second threshold, it may be determined that the life of the photoconductor 1 has expired.

Meanwhile, if the cumulative value of the number of pixels is largest in a region other than the central region, i.e., if another region has deteriorated most, whether or not the life of the photoconductor 1 has expired is determined on the basis of the degree of deterioration of the other region.

Hereinafter, the largest of the respective cumulative values corresponding to the plurality of regions will be referred to as the maximum cumulative value CTmax. If a region other than the central region has deteriorated most, the background portion potential Vd in that other region may be calculated from the following equation:

$$Vd = V1 \times \alpha \times CTc/CT\max \quad (1)$$

In the above equation, V1 represents the measured background portion potential value, a represents a coefficient, CTc represents the central cumulative value, and CTmax represents the maximum cumulative value. The coefficient α is a numerical value equal to or smaller than 1 determined on the basis of an experiment of comparing the actual measurement result of the background portion potential Vd with the calculation result of the background portion potential Vd calculated from a numerical formula. The central cumulative value CTc is smaller than the maximum cumulative value CTmax. Thus, the value CTc/CTmax is smaller than 1. Accordingly, the value of the background portion potential Vd is smaller than the measured background portion potential value V1. This is because the most heavily deteriorated region is more difficult to charge than the central region.

Further, if a region other than the central region has most heavily deteriorated, the latent image potential V1 in that other region may be calculated from the following equation:

$$V1 = V2 \times \beta \times CT\max/CTc \quad (2)$$

In the above equation, V2 represents the measured latent image potential value, β represents a coefficient, CTmax represents the maximum cumulative value, and CTc represents the central cumulative value. The coefficient β is a numerical value equal to or greater than 1 determined on the basis of an experiment of comparing the actual measurement result of the latent image potential V1 with the calculation result of the latent image potential V1 calculated from a numerical formula. The central cumulative value CTc is smaller than the maximum cumulative value CTmax. Thus, the value CTmax/CTc is greater than 1. Accordingly, the value of the latent image potential V1 is larger than the measured latent image potential value V2. This is because the potential attenuation rate in the exposure process is lower in the most heavily deteriorated region than in the central region.

Further, if a region other than the central region has most heavily deteriorated, the residual potential Vr in that other region may be calculated from the following equation:

$$Vr=V3\times\gamma\times CT\max/CTc \quad (3)$$

In the above equation, V3 represents the measured residual potential value, γ represents a coefficient, CTmax represents the maximum cumulative value, and CTc represents the central cumulative value. The coefficient γ is a numerical value equal to or greater than 1 determined on the basis of an experiment of comparing the actual measurement result of the residual potential Vr with the calculation result of the residual potential Vr calculated from a numerical formula. The central cumulative value CTc is smaller than the maximum cumulative value CTmax. Thus, the value CTmax/CTc is greater than 1. Accordingly, the value of the residual potential Vr is larger than the measured residual potential value V3. This is because the potential attenuation rate in the exposure process is lower in the most heavily deteriorated region than in the central region.

As described above, the determination unit 16 (i.e., determination device) determines the degree of deterioration of the non-detection region on the basis of the readings from the surface potential sensor 3 (i.e., surface potential detector) and the ratio between the cumulative value corresponding to the detection region and the cumulative value corresponding to the non-detection region (i.e., CTc/CTmax or CTmax/CTc). According to this configuration, the degree of deterioration of the non-detection region is calculated from the ratio between the degree of deterioration of the non-detection region and the degree of deterioration of the detection region detectable from the readings of the surface potential.

Further, as described above, the determination unit 16 determines whether or not the life of the photoconductor 1 (i.e., latent image carrier) has expired on the basis of the degree of deterioration of the region having the largest cumulative value (i.e., maximum cumulative value CTmax). According to this configuration, the time at which the life of the photoconductor 1 has expired is appropriately detected on the basis of the degree of deterioration of the most heavily deteriorated region.

Figure 7:
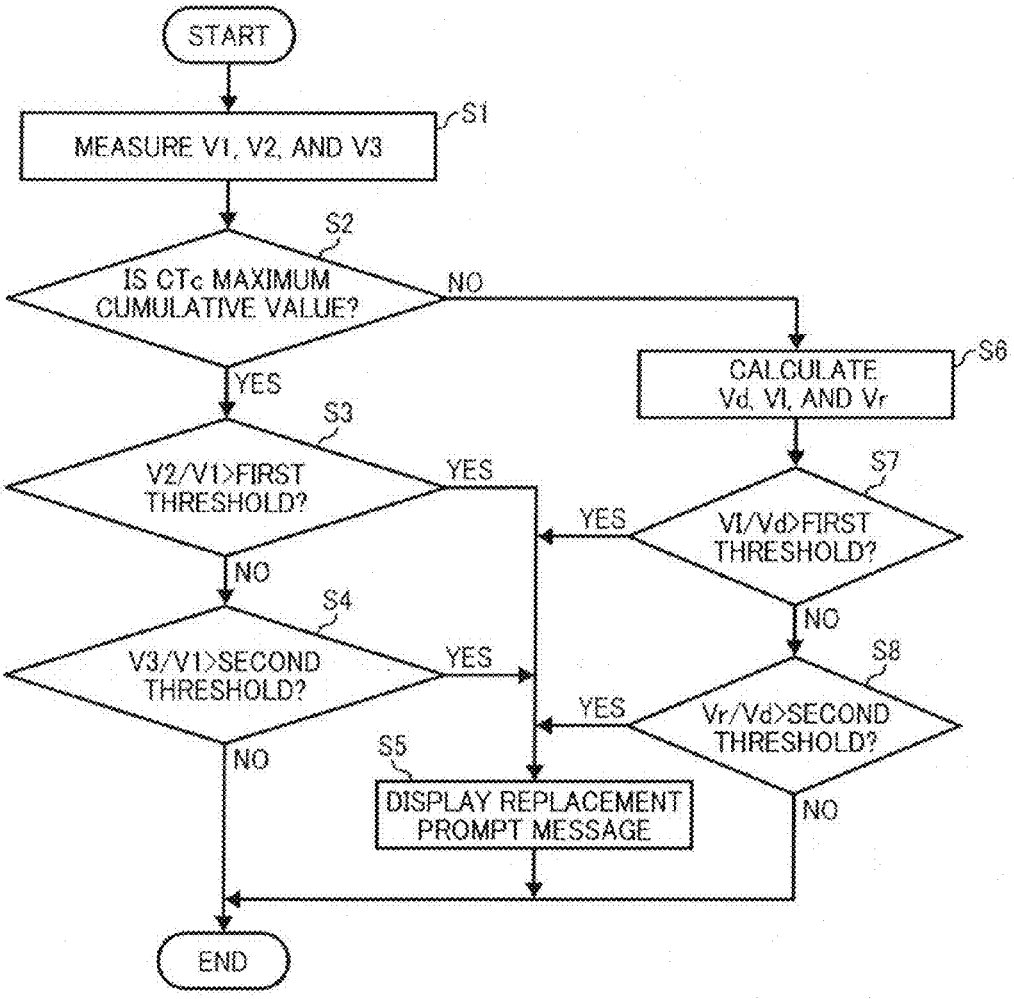
FIG. 7 is a flowchart illustrating steps of a determination process performed by the printer.

FIG. 7 is a flowchart illustrating steps of the determination process performed by the present printer 1000. Upon start of the determination process, the printer 1000 first performs measurements to obtain the measured background portion potential value V1, the measured latent image potential value V2, and the measured residual potential value V3 (step S1). These measurements are performed by the combination of the main controller 100 and the surface potential sensor 3.

After the measured background portion potential value V1, the measured latent image potential value V2, and the measured residual potential value V3 are obtained, the main controller 100 transmits the respective measurement results to the determination unit 16. Upon receipt of the transmitted measurement results, the determination unit 16 acquires from the pixel counter 17 respective cumulative values corresponding to the plurality of regions. The determination unit 16 then determines whether or not the central cumulative value CTc is the largest of the cumulative values, i.e., whether or not the central region has deteriorated most (step S2).

Then, if it is determined that the central cumulative value CTc is the largest of the cumulative values (YES at step S2), the determination unit 16 determines whether or not the value V2/V1 exceeds the first threshold (step S3). If it is determined that the value V2/V1 does not exceed the first threshold (NO at step S3), the determination unit 16 determines whether or not the value V3/V1 exceeds the second threshold (step S4). If it is determined YES at step S3 or step S4, the determination unit 16 determines that the life of the photoconductor 1 has expired, and transmits a message notification signal to the main controller 100. Meanwhile, if it is determined NO at both step S3 and step S4, the determination unit 16 determines that the life of the photoconductor 1 has not expired, and transmits a message non-notification signal to the main controller 100.

If the message notification signal is transmitted from the determination unit 16, the main controller 100 causes the operation display unit 15 to display a message prompting the replacement of the photoconductor 1 (step S5), and completes the determination process. If the message non-notification signal is transmitted from the determination unit 16, the main controller 100 completes the determination process without causing the operation display unit 15 to display the replacement prompt message.

If it is determined in the above-described step S2 that the central cumulative value CTc is not the largest of the cumulative values (NO at step S2), the determination unit 16 calculates the background portion potential Vd, the latent image potential V1, and the residual potential Vr from the above-described equations (1) to (3) (step S6). The determination unit 16 then determines whether or not the value V1/Vd exceeds the first threshold (step S7). If it is determined that the value V1/Vd does not exceed the first threshold (NO at step S7), the determination unit 16 determines whether or not the value Vr/Vd exceeds the second threshold (step S8). If it is determined YES at step S7 or step S8, the determination unit 16 determines that the life of the photoconductor 1 has expired, and transmits the message notification signal to the main controller 100. Meanwhile, if it is determined NO at both step S7 and step S8, the determination unit 16 determines that the life of the photoconductor 1 has not expired, and transmits the message non-notification signal to the main controller 100.

With the above-described determination process, the degree of deterioration is detected for each of the plurality of regions with no need to provide a plurality of surface potential sensors 3. Further, the end of life of the photoconductor 1 is appropriately detected on the basis of the degree of deterioration of the most heavily deteriorated region (i.e., the values V2/V1 and V3/V1 or the values V1/Vd and Vr/Vd).

If the message notification signal is transmitted from the determination unit 16, the main controller 100 transmits an order signal for ordering the photoconductor 1 and an identification (ID) number assigned to the present printer 1000 to the maintenance and management server 200 via the communication unit 14, to thereby automatically order a new photoconductor 1.

After the replacement with the new photoconductor 1, replacement completion information is input to the operation display unit 15 to delete the message displayed on the operation display unit 15. Upon input of the replacement completion information, the main controller 100 transmits a reset signal to the pixel counter 17. Upon receipt of the reset signal, the pixel counter 17 resets the respective cumulative values corresponding to the regions to zero. The number of pixels starts to be accumulated again from the start, with the initial value reset to zero. Herein, the operation display unit 15 and the main controller 100 cooperate to function as a replacement detector which detects the replacement of the photoconductor (i.e., latent image carrier). Further, the pixel counter 17 (i.e., cumulative value calculation device) resets the cumulative value for each of the regions on the basis of the detection of the replacement of the photoconductor 1 by the replacement detector. According to this configuration, the cumulative value starts to be calculated from zero for each of the regions of the newly installed photoconductor 1.

In the above-described example, the degree of deterioration of each of the regions of the photoconductor 1 is determined by the use of the values V2/V1 and V3/V1 or the values V1/Vd and Vr/Vd as index values representing the degree of deterioration. The index values, however, are not limited thereto. For example, if the photoconductor 1 is uniformly charged under the same voltage condition in the determination process irrespective of the result of the process control, the measured background portion potential value V1 and the background portion potential Vd may be employed as the index values. This is because, if the photoconductor 1 is uniformly charged under the same potential condition, the respective values of the measured background portion potential value V1 and the background portion potential Vd directly reflect the degree of deterioration. Similarly, if the photoconductor 1 is uniformly charged under the same potential condition, the respective values of the measured latent image potential value V2, the latent image potential V1, the measured residual potential value V3, and the residual potential Vr directly reflect the degree of deterioration. Accordingly, the measured latent image potential value V2, the latent image potential V1, the measured residual potential value V3, and the residual potential Vr may be employed as the index values.

A description will now be given of a specific example of the printer 1000 according to another embodiment. The example of the printer 1000 is basically similar in configuration to the above-described printer 1000 according to the first embodiment, unless otherwise specified. In the following example, the optical scanning region in the rotation axis direction (i.e., main scanning direction) of the photoconductor 1 is divided into first to eleventh regions Da1 to Da11. The number of the regions, however, is not limited to eleven. However, preferably the number of regions is an odd number to position the central region at the center in the main scanning direction.

The main controller 100 performs two types of processing; i.e., the above-described common process control and a novel divided individual adjustment process, as image forming condition adjustment processing for adjusting the image forming conditions of the image forming unit, such as the development potential for forming the toner image, for each of the regions on the basis of the corresponding cumulative value. The process control is performed at regular intervals of, for example, 100 prints. Herein, the main controller 100 serves as an image forming condition adjustment device. According to this configuration, variation in image density between the regions is minimized.

Figure 8:
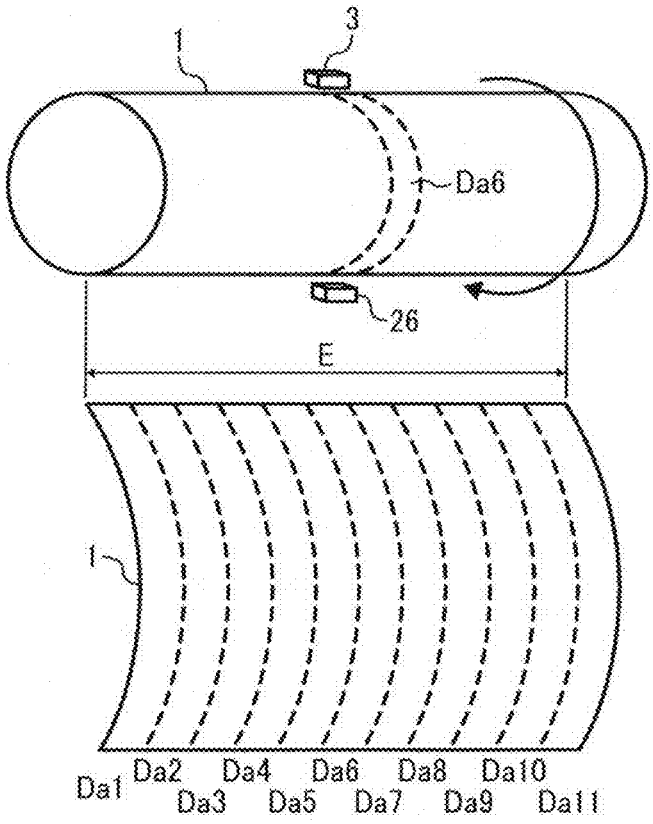
FIG. 8 is a schematic diagram illustrating relative positions of sensors and the regions of the photoconductor in an example of the printer.

FIG. 8 is a schematic diagram illustrating relative positions of sensors and the regions of the photoconductor 1 in the present example of the printer 1000. The sixth region Da6 of the eleven regions of the photoconductor 1 is located at the center in the rotation axis direction of the photoconductor 1. The surface potential sensor 3 is disposed to detect the surface potential of the sixth region Da6. Further, the present example of the printer 1000 includes a later-described adhesion amount sensor 26 disposed to detect the toner adhesion amount per unit area of the toner image formed on the sixth region Da6.

If a consecutive print job is ongoing at the time of execution of the process control, the main controller 100 temporarily stops the consecutive print job after completing the output of an image on the current recording sheet P. If a print job is being completed at the time of execution of the process control, post-processing for completing the print job is temporarily stopped to continue to drive various devices. Then, the main controller 100 forms a predetermined gradation pattern image on the sixth region Da6. The gradation pattern image includes a plurality of patch toner images having different toner adhesion amounts and aligned at a predetermined pitch in the direction of rotation of the outer circumferential surface of the photoconductor 1. The patch toner images are developed with different development potentials, and thus have different toner adhesion amounts per unit area. In the process control, the main controller 100 changes the laser power to be supplied to laser diodes of the optical writing device 8, to thereby change development potential. The value of the laser power is correlated with the optical writing intensity. That is, the main controller 100 (i.e., image forming condition adjustment device) adjusts, as one of the image forming conditions, the intensity of writing by the optical writing device 8 (i.e., latent image writing device). According to this configuration, the intensity of writing, which is individually adjustable for each of the regions, is adjusted as one of the image forming conditions, to thereby individually adjust imageability for each of the regions and thus obtain a desired image density.

The respective toner adhesion amounts of the patch toner images are detected at a position at which the patch toner images face the adhesion amount sensor 26, which is a reflective photosensor. On the basis of the respective detected toner adhesion amounts and the respective development potentials for developing the patch toner images, the main controller 100 calculates an approximate straight line representing the relationship between the toner adhesion amount and the development potential in accordance with, for example, the least squares method. Then, on the basis of the approximate straight line and a previously stored target adhesion amount, the main controller 100 calculates the development potential with which the target adhesion amount is obtained. On the basis of the calculation result, the main controller 100 determines the combination of the charging bias to be supplied to the charging brush roller of the charging device 2, the development bias to be supplied to the development roller of the development device 4, and the laser power. Accordingly, the development potential is set to the value at which the target adhesion amount is obtained, to thereby adjust the image density close to the target value.

With the above-described common process control, the target image density is obtained in the sixth region Da6. If the degree of deterioration of the photoconductor 1 varies in the rotation axis direction, however, the development potential varies between the regions, and thus may cause variation in image density in the rotation axis direction.

Therefore, the main controller 100 regularly performs the novel divided individual adjustment process to suppress the variation in image density. In the present example of the printer 1000, the regular execution cycle of the divided individual adjustment process corresponds to one rotation of the photoconductor 1. The regular execution cycle of the divided individual adjustment process, however, is not limited thereto, and may correspond to two rotations of the photoconductor 1 or a predetermined number of prints. In any case, it is desirable that the divided individual adjustment process is performed every time the outer circumferential surface of the photoconductor 1 moves a predetermined distance. That is, the pixel counter 17 (i.e., cumulative value calculation device) calculates the cumulative value for each of the regions every time the outer circumferential surface of the photoconductor 1 (i.e., latent image carrier) moves a predetermined distance, and the main controller 100 (i.e., image forming condition adjustment device) adjusts, every time the outer circumferential surface of the photoconductor 1 moves the predetermined distance, the image forming conditions in any of the regions in which the cumulative value increases.

According to this configuration, every time the outer circumferential surface of the photoconductor 1 moves the predetermined distance, the image forming conditions are appropriately corrected in the regions in accordance with the respective degrees of deterioration progressing during the surface movement of the photoconductor 1, thereby suppressing the variation in image density between the regions. Further, the adjustment of the image forming conditions is limited to the regions subjected to the writing of the latent image, thereby saving an unnecessary arithmetic process, such as the calculation of the appropriate values of the image forming conditions for the regions not subjected to the writing of the latent image.

In the divided individual adjustment process, the number of optically written pixels output during one rotation of the photoconductor 1 is first counted. The number of pixels has a substantially large number of digits. In the counting of the number of optically written pixels, therefore, the numbers are rounded. Thus, for example, $10^3$ pixels are counted as 1, and fractions less than $10^3$ are omitted.

Figure 9:
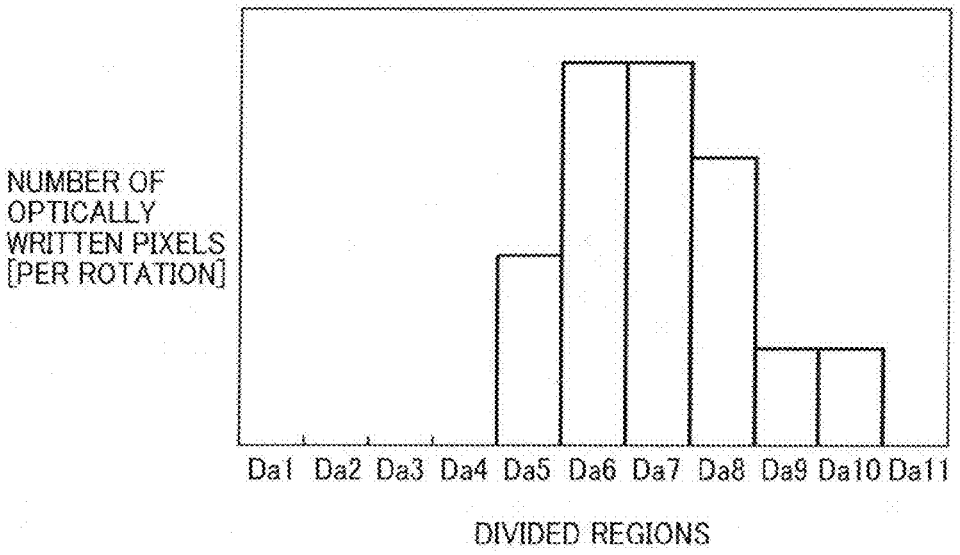
FIG. 9 is a graph illustrating an example of the result of counting the number of optically written pixels in a divided individual adjustment process performed by the printer.

FIG. 9 is a graph illustrating an example of the count result of the number of optically written pixels in the divided individual adjustment process. In this example, optical writing of dots takes place in six regions of the eleven regions, i.e., the fifth to tenth regions Da5 to Da10. Optical writing of dots does not take place in the remaining five regions.

In the divided individual adjustment process, the main controller 100 adjusts the image forming conditions in each of the regions in which optical writing of dots takes place, on the basis of the corresponding cumulative value of the number of pixels. In the example illustrated in FIG. 9, the main controller 100 adjusts the image forming conditions in each of the six regions of the eleven regions, i.e., the fifth to tenth regions Da5 to Da10, on the basis of the corresponding cumulative value of the number of pixels.

Figure 10:
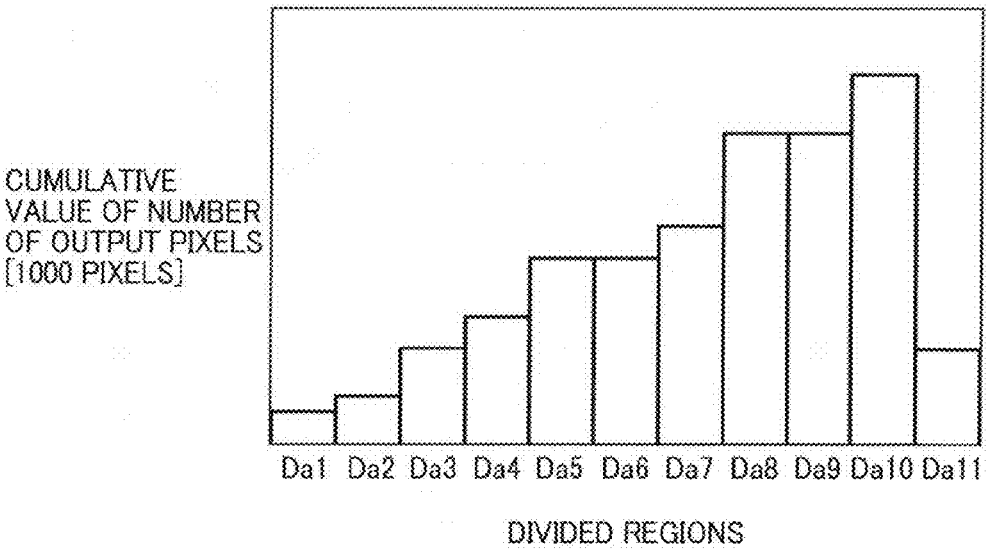
FIG. 10 is a graph illustrating the relationship between the regions of the photoconductor of the printer and the cumulative value of the number of pixels.

FIG. 10 is a graph illustrating the relationship between the regions of the photoconductor 1 and the cumulative value of the number of pixels. While FIG. 9 illustrates the number of optically written pixels output during one rotation of the photoconductor 1, FIG. 10 illustrates the cumulative value of the number of pixels output up to the present time. In FIG. 10, therefore, the number of pixels exceeds zero in the first region Da1, the second region Da2, the third region Da3, the fourth region Da4, and the eleventh region Da11, in which the number of optically written pixels is zero in FIG. 9. In the example of FIG. 9, optical writing of dots takes place in the six regions of the fifth to tenth regions Da5 to Da10. Therefore, the image forming conditions are adjusted for the six regions.

In the divided individual adjustment process, the main controller 100 individually adjusts the image forming conditions for each of the regions with reference to the cumulative value of the number of pixels in the sixth region Da6, in which the surface potential is detected by the surface potential sensor 3. Specifically, in the above-described process control, the main controller 100 stores the combination of the target range of the background portion potential Vd, the target range of the latent image potential V1, and the target range of the residual potential Vr in a data storage unit, such as a RAM or a flash memory. In the example illustrated in FIG. 9, the latent image potential V1 is estimated for each of the six regions of the fifth to tenth regions Da5 to Da10, in which optical writing of dots takes place, with reference to the cumulative value of the number of pixels in the sixth region Da6.

Specifically, an estimated latent image potential value V15*a* of the fifth region Da5 is calculated from an equation $V15a=V2\times\beta\times D5/D6$. In this equation, β represents a predetermined coefficient previously determined on the basis of experimental results. Further, D5 represents the cumulative value of the number of pixels in the fifth region Da5, and D6 represents the cumulative value of the number of pixels in the sixth region Da6. The ratio of the cumulative value D5 of the number of pixels in the fifth region Da5 to the cumulative value D6 of the number of pixels in the sixth region Da6 is multiplied by the previous estimated value, since the estimated latent image potential value V15*a* of the fifth region Da5 is estimated with reference to the measured latent image potential value V2 of the sixth region Da6.

It is difficult to obtain the measured background portion potential value V1, the measured latent image potential value V2, and the measured residual potential value V3 at every rotation of the photoconductor 1. Therefore, the main controller 100 stores and uses the most recently measured values for the measured background portion potential value V1, the measured latent image potential value V2, and the measured residual potential value V3. That is, the measured background portion potential value V1, the measured latent image potential value V2, and the measured residual potential value V3 are obtained after the start of a print job and before the start of an image forming operation. In a consecutive print job, consecutive printing is temporarily stopped every time the number of consecutive prints exceeds a predetermined threshold (e.g., 50 prints) to obtain the measured background portion potential value V1, the measured latent image potential value V2, and the measured residual potential value V3.

The main controller 100 similarly calculates an estimated latent image potential value V17*a* of the seventh region Da1 from an equation $V17a=V2\times\beta\times D7/D6$, and calculates an estimated latent image potential value V18*a* of the eighth region Dab from an equation $V18a=V2\times\beta\times D8/D6$. Further, the main controller 100 calculates an estimated latent image potential value V19*a* of the ninth region Da9 from an equation $V19a=V2\times\beta\times D9/D6$, and calculates an estimated latent image potential value V10*a* of the tenth region Da10 from an equation $V10a=V2\times\beta\times D10/D6$.

After the six estimated latent image potential values are calculated in the above-described manner, whether or not the estimated latent image potential values are within the previously stored target range is determined. If any of the estimated latent image potential values is out of the target range, appropriate laser power for the region corresponding to the estimated latent image potential value is calculated from a predetermined algorithm. Thereafter, the laser power for optical writing on the region is set to the calculated value. The algorithm is intended to calculate appropriate laser power for shifting the estimated latent image potential value to the median of the target range of the latent image potential V1 by using, for example, the difference between the median of the target range of the latent image potential V1 and the estimated latent image potential value and the present value of the laser power in the corresponding region.

With this adjustment of the laser power as an image forming condition, it is possible to form an image at a desired image density in each of the regions, irrespective of the variation in degree of deterioration of the photoconductor 1 between the regions. Further, the adjustment of the laser power is limited to the regions subjected to the optical writing of dots, thereby saving an unnecessary arithmetic process, such as the calculation of the appropriate laser power for the regions in which the adjustment is unnecessary.

In the image forming condition adjustment processing, the main controller 100 adjusts the charging bias and the numerical values of the respective target ranges, in addition to the laser power. The charging bias is corrected to an appropriate value by the above-described process control. However, if the outer circumferential surface of the photoconductor 1 deteriorates fast owing to, for example, a substantial increase in frequency of optical writing before the next process control, the background portion potential Vd may deviate from the target range. For this reason, the charging bias is corrected by the divided individual adjustment process, which is performed at shorter execution intervals than the process control.

The charging bias uniformly acts on the entire outer circumferential surface in the rotation axis direction of the photoconductor 1, and it is difficult to individually set the value of the charging bias for each of the regions. Therefore, the charging bias is set to an average value with which a similar effect is obtained in the respective regions. Accordingly, the main controller 100 calculates an estimated background portion potential value Vda of the sixth region Da6 from an equation $Vda=V1\times\alpha\times D6/Dwa$. In this equation, $\alpha$ represents a predetermined coefficient previously determined on the basis of experimental results. Further, Dwa represents the average (i.e., weighted average) of the sum of weighted cumulative values of the respective numbers of pixels in the fifth to tenth regions Da5 to Da10. After the estimated background portion potential value Vda is thus calculated, whether or not the estimated background portion potential value Vda is within the corresponding target range is determined. If the estimated background portion potential value Vda is not within the target range, an appropriate charging bias is calculated from a predetermined algorithm, and the charging bias is thereafter set to the calculated appropriate charging bias. The algorithm is intended to calculate an appropriate charging bias for shifting the estimated background portion potential value Vda to the target range by using, for example, the difference between the estimated background portion potential value Vda and the background portion potential Vd and the present value of the charging bias.

The above description "Dwa represents the average (i.e., weighted average) of the sum of weighted cumulative values of the respective numbers of pixels in the fifth to tenth regions Da5 to Da10" applies to the example illustrated in FIG. 9, in which optical writing takes place in the fifth to tenth regions Da5 to Da10. The regions referenced to calculate the average Dwa changes depending on the situation. Further, the average Dwa may be calculated from weighted cumulative values of the respective numbers of optically written pixels in the regions subjected to optical writing, which are weighted more with an increase in number of optically written pixels.

As the outer circumferential surface of the photoconductor 1 is worn by repeated optical writing, the post-discharge residual potential Vr increases, thereby changing the charging properties and the attenuation rate of the potential in the exposed portion. Therefore, the main controller 100 estimates the residual potential Vr as an estimated residual potential value Vra. Then, if the estimated residual potential value Vra is not within the corresponding target range, the respective target ranges of the background portion potential Vd and the latent image potential V1 are corrected on the basis of the difference between the estimated residual potential value Vra and the median of the target range, to thereby obtain a target image density. Specifically, the estimated residual potential value Vra is estimated from an equation $Vra=V3\times\gamma\times Dmax/D6$. In this equation, $\gamma$ represents a predetermined coefficient previously determined on the basis of experimental results, and Dmax represents the largest of the cumulative values of the respective numbers of pixels in the fifth to tenth regions Da5 to Da10. If the thus-calculated estimated residual potential value Vra is not within the target range, the main controller 100 corrects the respective target ranges of the background portion potential Vd and the latent image potential V1 on the basis of the difference between the median of the target range and the estimated residual potential value Vr.

Figure 11:
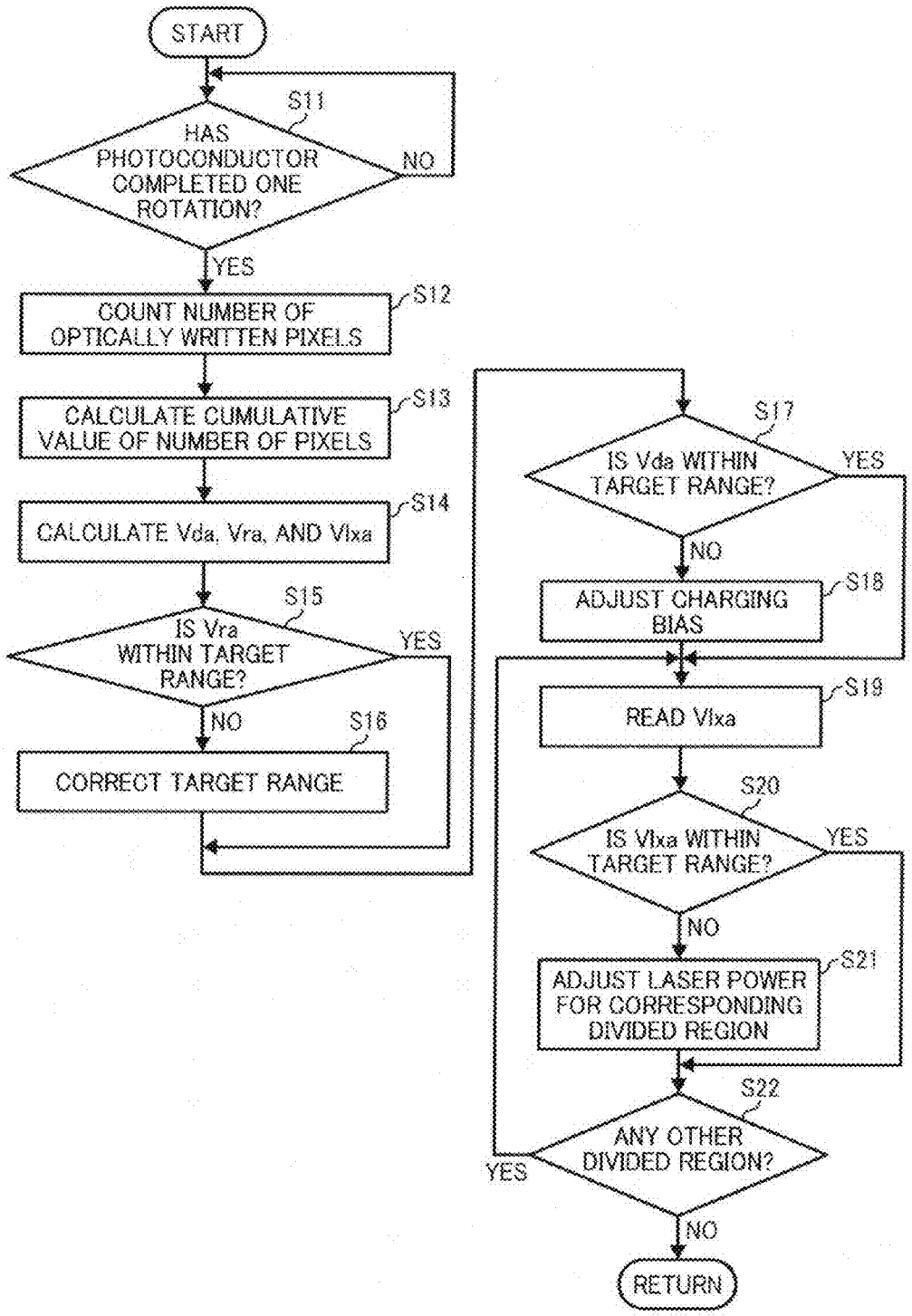
FIG. 11 is a flowchart illustrating steps of the divided individual adjustment process.

FIG. 11 is a flowchart illustrating steps of the divided individual adjustment process. The main controller 100 first waits for the photoconductor 1 to complete one rotation (step S11). After one rotation of the photoconductor 1, the main controller 100 counts the number of optically written pixels for each of the eleven regions (step S12), and calculates the cumulative value of the number of pixels (step S13). Then, the main controller 100 calculates the estimated background portion potential value Vda and the estimated residual potential value Vra described above and an estimated latent image potential value V1*xa* of each of the regions subjected to optical writing (x represents the number of the region) (step S14). Then, if the calculated estimated residual potential value Vra is not within the target range (NO at step S15), the main controller 100 corrects the respective target ranges of the background portion potential Vd and the latent image potential V1 (step S16), as described above. Further, if the calculated estimated background portion potential value Vda is not within the target range (NO at step S17), the main controller 100 adjusts the charging bias (step S18), as described above. Then, the main controller 100 reads the estimated latent image potential value V1*xa* of one of the regions subjected to optical writing during the one rotation of the photoconductor 1 (step S19), and determines whether or not the estimated latent image potential value V1*xa* is within the corresponding target range (step S20). Then, if the estimated latent image potential value V1*xa* is not within the target range (NO at step S20), the main controller 100 adjusts the laser power for the region corresponding to the estimated latent image potential value V1*xa* (step S21), as described above. Thereafter, it there is any other region subjected to optical writing and not subjected to the determination of whether or not the adjustment of the laser power is necessary (YES at step S22), the divided individual adjustment process returns to the above-described step S9 to adjust the laser power for the region as necessary. If the determination of whether or not the adjustment of the laser power is necessary is made for all of the regions subjected to optical writing (NO at step S22), the divided individual adjustment process returns to the above-described step S11 to wait for the photoconductor 1 to complete another rotation.

With the above-described divided individual adjustment process, the desired image density is reliably obtained in each of the regions, irrespective of differences in frequency of optical writing between the regions.

According to the above-described embodiments, an image forming apparatus (i.e., printer 1000) includes an image forming unit, a cumulative value calculation device (i.e., pixel counter 17), a surface potential detector (i.e., surface potential sensor 3), and a determination device (i.e., determination unit 16). The image forming unit includes at least a latent image carrier (i.e., photoconductor 1) that carries a latent image on a moving surface (i.e., outer circumferential surface) thereof, a charging device (i.e., charging device 2) that charges the surface of the latent image carrier, a latent image writing device (i.e., optical writing device 8) that writes the latent image on the charged surface of the latent image carrier, and a development device (i.e., development device 4) that develops the latent image carried on the surface of the latent image carrier. The cumulative value calculation device calculates, for each of a plurality of regions of the surface of the latent image carrier divided in a direction perpendicular to a direction of rotation of the latent image carrier, a cumulative value of the area of the latent image formed in the region. The surface potential detector detects the electric potential of the surface of the latent image in one of the plurality of regions as a detection region. The determination device determines the degree of deterioration of the latent image carrier on the basis of readings from the surface potential detector. The determination device determines the degree of deterioration of the detection region on the basis of the readings, and determines the degree of deterioration of a region other than the detection region on the basis of the readings, the cumulative value for the detection region, and the cumulative value for the region other than the detection region.

In the thus-configured embodiment, the cumulative value of the area of the latent image calculated for each of the plurality of regions is reflected by the frequency of writing of the latent image on the region in an extended period of time. Therefore, the larger the cumulative value of the frequency of writing of the latent image in the region is, the more deteriorated the region is. Further, the degree of deterioration of each of the non-detection regions of the plurality of regions not subjected to the detection of the surface potential by the surface potential detector deviates from the degree of deterioration of the detection region of the plurality of regions subjected to the detection of the surface potential by the surface potential sensor 3, in accordance with the difference or ratio between the cumulative values corresponding to the regions. Further, the readings of the surface potential detected by the surface potential detector reflect the degree of deterioration of the detection region. Therefore, the degree of deterioration of the non-detection region is obtained on the basis of the readings of the surface potential and the calculation using the above-described difference or ratio. With the thus-obtained degree of deterioration of the non-detection region, it is possible to detect the degree of deterioration of each of the plurality of regions aligned in the direction perpendicular to the direction of rotation of the latent image carrier, with no need to provide a plurality of surface potential detectors.

The above-described embodiments and effects thereof are illustrative only and do not limit the present invention. Thus, numerous additional modifications and variations are possible in light of the above teachings. For example, elements or features of different illustrative and embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

What is claimed is:

1. An image forming apparatus comprising:

an image forming unit including a latent image carrier configured to carry a latent image on a moving surface thereof, a charging device configured to charge the surface of the latent image carrier, a latent image writing device configured to write the latent image on the charged surface of the latent image carrier, and a development device configured to develop the latent image carried on the surface of the latent image carrier;

a cumulative value calculation device configured to calculate, for each of a plurality of regions into which the surface of the latent image carrier is divided in a direction perpendicular to a direction of rotation of the latent image carrier, a cumulative value of the area of the latent image formed in the region;

a surface potential detector configured to detect the electric potential of the surface of the latent image in one of the plurality of regions as a detection region; and a determination device configured to:

determine the degree of deterioration of the latent image carrier on the basis of readings from the surface potential detector;

determine the degree of deterioration of the detection region on the basis of the readings; and determine the degree of deterioration of a region other than the detection region on the basis of the readings, the cumulative value for the detection region, and the cumulative value for the region other than the detection region.

2. The image forming apparatus according to claim 1, wherein the determination device determines the degree of deterioration of the region other than the detection region on the basis of the readings and the ratio between the cumulative value for the detection region and the cumulative value for the region other than the detection region.

3. The image forming apparatus according to claim 2, wherein the determination device determines whether or not the life of the latent image carrier has expired on the basis of the degree of deterioration of one of the plurality of regions having the largest cumulative value.

4. The image forming apparatus according to claim 1, wherein the cumulative value calculation device calculates, as the cumulative value of the area of the latent image, the cumulative value of the number of pixels of the formed latent image.

5. The image forming apparatus according to claim 1, further comprising:

a replacement detector configured to detect the replacement of the latent image carrier, wherein the cumulative value calculation device resets the cumulative value for each of the plurality of regions on the basis of the detection of the replacement of the latent image carrier by the replacement detector.

6. The image forming apparatus according to claim 1, further comprising:

an image forming condition adjustment device configured to adjust image forming conditions of the image forming unit for each of the plurality of regions on the basis of the cumulative value.

7. The image forming apparatus according to claim 6, wherein the cumulative value calculation device calculates the cumulative value for each of the plurality of regions every time the surface of the latent image carrier moves a predetermined distance, and wherein, every time the surface of the latent image carrier moves the predetermined distance, the image forming condition adjustment device adjusts the image forming conditions in any of the plurality of regions in which the cumulative value increases.

8. The image forming apparatus according to claim 7, wherein the image forming condition adjustment device adjusts, as one of the image forming conditions, the intensity of writing by the latent image writing device.

* * * * *